US011492804B2

(12) United States Patent
Shiao et al.

(10) Patent No.: US 11,492,804 B2
(45) Date of Patent: Nov. 8, 2022

(54) STEEP SLOPE ROOFING SYSTEM

(71) Applicant: BMIC LLC, Dallas, TX (US)

(72) Inventors: Ming Shiao, Basking Ridge, NJ (US); Erica Sherman, Jersey City, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/713,976

(22) Filed: Apr. 5, 2022

(65) Prior Publication Data

US 2022/0325525 A1 Oct. 13, 2022

Related U.S. Application Data

(60) Provisional application No. 63/171,821, filed on Apr. 7, 2021.

(51) Int. Cl.

| | |
|---|---|
| ***E04D 1/30*** | (2006.01) |
| ***E04D 1/22*** | (2006.01) |
| ***E04D 13/00*** | (2006.01) |

(52) U.S. Cl.

CPC ..... *E04D 1/30* (2013.01); *E04D 1/22* (2013.01); *E04D 13/002* (2013.01); *E04D 2001/308* (2013.01)

(58) Field of Classification Search

CPC ..... E04D 13/002; E04D 13/076; E04D 1/30; E04D 1/22; E04D 2001/308

See application file for complete search history.

(56) References Cited

U.S. PATENT DOCUMENTS

| | | | | |
|---|---|---|---|---|
| 4,276,732 | A * | 7/1981 | Nielsen | A01N 59/20 422/291 |
| 6,134,843 | A * | 10/2000 | Tregear | E04D 13/076 52/12 |
| 6,248,233 | B1 * | 6/2001 | Priggemeyer | E03B 3/02 210/170.03 |
| 7,584,577 | B2 * | 9/2009 | Esmond | E04D 13/08 52/12 |
| 7,788,870 | B1 * | 9/2010 | Spencer | E04D 13/002 52/530 |
| 8,479,454 | B2 * | 7/2013 | Lenney | E04D 13/076 52/12 |
| 10,202,771 | B2 * | 2/2019 | Edgson | E04D 13/002 |

(Continued)

*Primary Examiner* — Babajide A Demuren
*Assistant Examiner* — Daniel J Kenny
(74) *Attorney, Agent, or Firm* — Greenberg Traurig, LLP

(57) ABSTRACT

Some embodiments of the present disclosure relate to a roofing system. In some embodiments, the roofing system comprises at least one steep slope roof substrate having a first region. In some embodiments, the first region comprises a plurality of shingles. In some embodiments, each of the plurality of shingles comprises at least one antimicrobial agent. In some embodiments, the at least one steep slope roof substrate also comprises a second region. In some embodiments, the second region comprises an antimicrobial scavenger layer that is configured to receive runoff from the first region of the steep slope roof substrate. In some embodiments, the runoff comprises an initial concentration of at least one antimicrobial agent and water. In some embodiments, the antimicrobial scavenger layer is configured to capture the at least one antimicrobial agent so as to reduce the initial concentration of the at least one antimicrobial agent in the runoff.

18 Claims, 2 Drawing Sheets

(56) References Cited

U.S. PATENT DOCUMENTS

| | | | | |
|---|---|---|---|---|
| 10,370,855 | B2 * | 8/2019 | Gassman | E04D 13/178 |
| 2003/0091795 | A1 * | 5/2003 | Kiik | E04D 7/005 428/148 |
| 2003/0150170 | A1 * | 8/2003 | Weber | E04D 13/00 52/518 |
| 2013/0171414 | A1 | 7/2013 | Shiao et al. | |
| 2019/0153730 | A1 * | 5/2019 | Sager | E04D 13/076 |
| 2019/0185681 | A1 * | 6/2019 | Anderson | C09D 123/04 |

* cited by examiner

STEEP SLOPE ROOFING SYSTEM

This application claims priority to U.S. Provisional Application No. 63/171,821, filed on Apr. 7, 2021, the entire contents of which are incorporated herein by reference.

FIELD

The present disclosure relates to scavenger layers for steep slope roofs.

BACKGROUND

Some roofing systems include sloped roof decks with shingles. In some instances, water may run off the shingles on the steep slope roof decks into gutters.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Some embodiments of the present disclosure are directed to a roofing system comprising at least one steep slope roof substrate, wherein the at least one steep slope roof substrate comprises: a first region, wherein the first region of the at least one steep slope roof substrate comprises a plurality of shingles, and wherein the shingles comprise at least one antimicrobial agent; and a second region, wherein the second region is downslope of the first region; wherein the second region of the at least one steep slope roof substrate comprises an antimicrobial scavenger layer, wherein the antimicrobial scavenger layer is configured to receive runoff from the first region 12 of the steep slope roof substrate, wherein the runoff comprises: at least one antimicrobial agent; and water; and wherein the antimicrobial scavenger layer is configured to capture the at least one antimicrobial agent so as to reduce a concentration of the at least one antimicrobial agent in the runoff.

In some embodiments, the plurality of shingles comprises a plurality of antimicrobial agent, wherein the antimicrobial agent comprises: a polymer matrix; and the at least one antimicrobial agent.

In some embodiments, the at least one antimicrobial agent is present within the polymer matrix.

In some embodiments, the polymer matrix comprises polyethylene (PE), polypropylene (PP), or any combination thereof.

In some embodiments, the at least one antimicrobial agent comprises at least one metal, at least one metal ion, or any combination thereof.

In some embodiments, the at least one metal, the at least one metal ion, or the combination thereof comprises copper, at least one copper ion, or any combination thereof.

In some embodiments, the at least one antimicrobial agent comprises at least one algaecide, at least one biocide, at least one fungicide, or any combination thereof.

In some embodiments, the roofing system further comprises a collection system, wherein the collection system is configured to collect the runoff from the antimicrobial scavenger layer.

In some embodiments, the collection system comprises a gutter.

In some embodiments, the runoff in the collection system has a reduced concentration of the at least one antimicrobial agent relative to the initial concentration of the at least one antimicrobial agent in the runoff from the first region of the steep slope roof substrate.

In some embodiments, the reduced concentration of the at least one antimicrobial agent in the runoff in the collection system is 0 ppm to 500 ppm.

In some embodiments, the concentration of the at least one antimicrobial agent in the runoff from the first region of the steep slope roof substrate is 50 ppm to 1500 ppm.

In some embodiments, the second region of the at least one steep slope roof substrate further comprises: a shingle mimicking layer, wherein the shingle mimicking layer is disposed atop the antimicrobial scavenger layer, wherein the shingle mimicking layer comprises a plurality of openings, and wherein the plurality of openings are sufficiently sized so as to allow the runoff to penetrate through the antimicrobial scavenger layer.

In some embodiments, the second region of the at least one steep slope roof substrate further comprises a water barrier layer, wherein the water barrier layer is disposed beneath the antimicrobial scavenger layer.

In some embodiments the shingle mimicking layer comprises a porous material, wherein the plurality of openings comprise a plurality of pores of the porous material, wherein the pores have an average size of 5 μm to 1000 μm.

In some embodiments, the at least one steep slope roof substrate comprises: a roof deck; and an underlayment, wherein the underlayment is disposed atop the roof deck, and wherein the underlayment is disposed beneath the plurality of shingles, disposed beneath the antimicrobial scavenger layer, or any combination thereof.

In some embodiments, the at least one of the plurality of shingles overlaps at least one portion of the antimicrobial scavenger layer.

Some embodiments of the present disclosure are directed to a method comprising: obtaining a plurality of shingles, wherein at least some of the plurality of shingles comprises an antimicrobial agent; installing the plurality of shingles on a first region of a steep slope roof substrate; obtaining an antimicrobial scavenger material; installing the antimicrobial scavenger material on a second region of the steep slope roof substrate so as to form an antimicrobial scavenger layer, wherein the second region is downslope of the first region; wherein the antimicrobial scavenger layer is configured to receive runoff from the plurality of shingles on the first region of the steep slope roof substrate, wherein the runoff comprises: at least one antimicrobial agent; and water; and wherein the antimicrobial scavenger layer is configured to capture the at least one antimicrobial agent so as to reduce a concentration of the at least one antimicrobial agent in the runoff.

In some embodiments, the method further comprises: obtaining a collection system wherein the collection system is configured to collect the runoff from the antimicrobial scavenger layer; and installing the collection system.

In some embodiments, installing the antimicrobial scavenger material on the second region of the steep slope roof substrate comprises: obtaining a water barrier material; positioning the water barrier material atop the second region of the steep slope roof substrate so as to form a water barrier layer; and positioning the antimicrobial scavenger material atop the water barrier layer so as to form the antimicrobial scavenger layer atop the water barrier layer.

DRAWINGS

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced.

DETAILED DESCRIPTION

Figure 1:
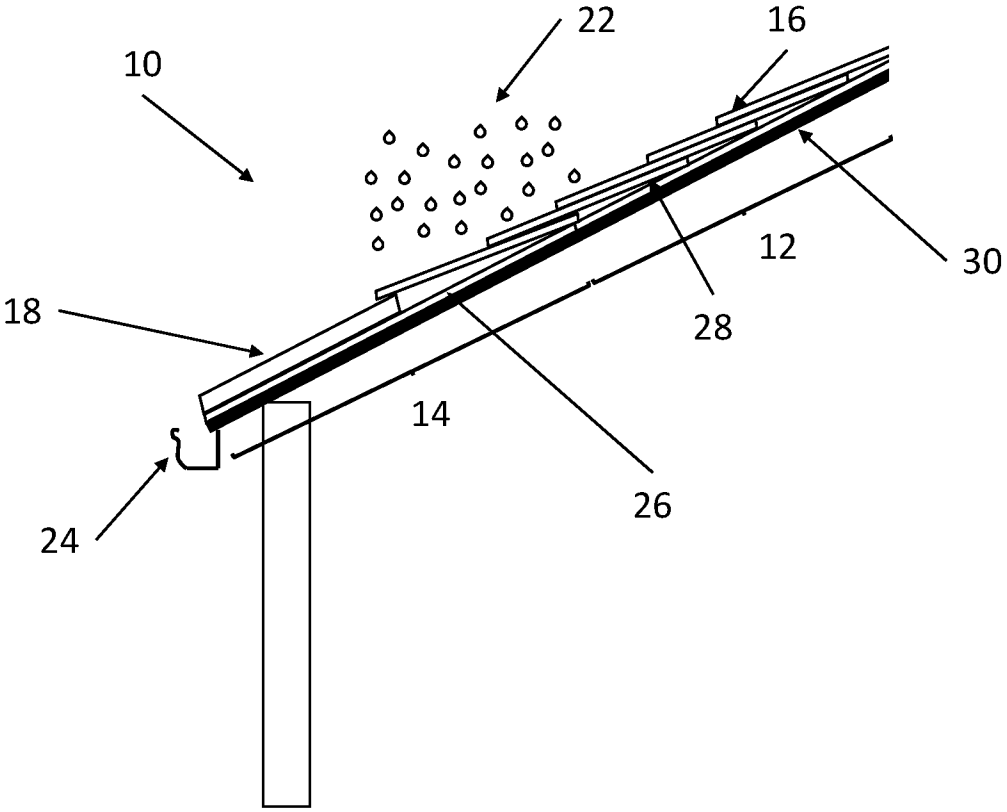
FIG. 1 depicts a roofing system according to an exemplary embodiment of the present disclosure.

Among those benefits and improvements that have been disclosed other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, the term "steep slope roof substrate" is any roof substrate that is disposed on a roof having a pitch of Y/X, where Y and X are in a ratio of 2:12 to 12:12, where Y corresponds to the "rise" of the roof, and where X corresponds to the "run" of the roof. In some embodiments, Y and X are in a ratio of 3:12 to 12:12. In some embodiments, Y and X are in a ratio of 4:12 to 12:12. In some embodiments, Y and X are in a ratio of 5:12 to 12:12. In some embodiments, Y and X are in a ratio of 6:12 to 12:12. In some embodiments, Y and X are in a ratio of 7:12 to 12:12. In some embodiments, Y and X are in a ratio of 8:12 to 12:12. In some embodiments, Y and X are in a ratio of 9:12 to 12:12. In some embodiments, Y and X are in a ratio of 10:12 to 12:12. In some embodiments, Y and X are in a ratio of 11:12 to 12:12. In some embodiments, Y and X are in a ratio of 2:12 to 11:12. In some embodiments, Y and X are in a ratio of 2:12 to 10:12. In some embodiments, Y and X are in a ratio of 2:12 to 9:12. In some embodiments, Y and X are in a ratio of 2:12 to 8:12. In some embodiments, Y and X are in a ratio of 2:12 to 7:12. In some embodiments, Y and X are in a ratio of 2:12 to 6:12. In some embodiments, Y and X are in a ratio of 2:12 to 5:12. In some embodiments, Y and X are in a ratio of 2:12 to 4:12. In some embodiments, Y and X are in a ratio of 2:12 to 3:12. In some embodiments, Y and X are in a ratio of 3:12 to 11:12. In some embodiments, Y and X are in a ratio of 4:12 to 10:12. In some embodiments, Y and X are in a ratio of 5:12 to 9:12. In some embodiments, Y and X are in a ratio of 6:12 to 8:12. In some embodiments, the steep slope roof substrate comprises a plywood substrate, a glass substrate, a fiberglass substrate (e.g., a fiberglass mat), a cellulosic substrate, an underlayment, a roof deck, a photovoltaic (PV) panel, a modified bitumen (MODBIT) substrate, a roll good, or any combination thereof.

As used herein, the term "antimicrobial agent" means a substance that may be configured to prohibit, prevent, destroy, slow, or any combination thereof the growth of microbes, including without limitation, roof algae, fungi, biofilm, lichen, or any combination thereof, on shingles. In some embodiments, the antimicrobial agent may comprise metal, at least one metal ion, at least one algaecide, at least one biocide, at least one fungicide, or any combination thereof. In some embodiments, the at least one metal, the at least one metal ion or the combination thereof comprises copper, at least one copper ion, or any combination thereof.

As used herein, the term "runoff" means a substance that has flowed along a surface. In some embodiments, the runoff may be a solid, liquid, gas, or any combination thereof. In some embodiments, the runoff may include water, such as, rain water, that has flowed along a steep slope roof substrate. In some embodiments, the runoff may include an initial concentration of a chemical or other substance that may have been present on the steep slope roof substrate. In some embodiments, the runoff may include an initial concentration of at least one antimicrobial agent.

In some embodiments, the initial concentration of the at least one antimicrobial agent in the runoff is from 50 ppm to 1500 ppm, from 50 ppm to 1450 ppm, from 50 ppm to 1400 ppm, from 50 ppm to 1350 ppm, from 50 ppm to 1300 ppm, from 50 ppm to 1250 ppm, from 50 ppm to 1200 ppm, from 50 ppm to 1150 ppm, from 50 ppm to 1100 ppm, from 50 ppm to 1050 ppm, from 50 ppm to 1000 ppm, from 50 ppm to 950 ppm, from 50 ppm to 900 ppm, from 50 ppm to 850 ppm, from 50 ppm to 800 ppm, from 50 ppm to 750 ppm, from 50 ppm to 700 ppm, from 50 ppm to 650 ppm, from 50 ppm to 600 ppm, from 50 ppm to 550 ppm, from 50 ppm to 500 ppm, from 50 ppm to 450 ppm, from 50 ppm to 400 ppm, from 50 ppm to 350 ppm, from 50 ppm to 300 ppm, from 50 ppm to 250 ppm, from 50 ppm to 200 ppm, from 50 ppm to 150 ppm, or from 50 ppm to 100 ppm.

In some embodiments, the initial concentration of the at least one antimicrobial agent in the runoff is from 50 ppm to 1500 ppm, from 100 ppm to 1500 ppm, from 150 ppm to 1500 ppm, from 200 ppm to 1500 ppm, from 250 ppm to 1500 ppm, from 300 ppm to 1500 ppm, from 350 ppm to 1500 ppm, from 400 ppm to 1500 ppm, from 450 ppm to 1500 ppm, from 500 ppm to 1500 ppm, from 550 ppm to 1500 ppm, from 600 ppm to 1500 ppm, from 650 ppm to 1500 ppm, from 700 ppm to 1500 ppm, from 750 ppm to 1500 ppm, from 800 ppm to 1500 ppm, from 850 ppm to 1500 ppm, from 900 ppm to 1500 ppm, from 950 ppm to 1500 ppm, from 1000 ppm to 1500 ppm, from 1050 ppm to 1500 ppm, from 1100 ppm to 1500 ppm, from 1150 ppm to 1500 ppm, from 1200 ppm to 1500 ppm, from 1250 ppm to 1500 ppm, from 1300 ppm to 1500 ppm, from 1350 ppm to 1500 ppm, from 1400 ppm to 1500 ppm, or from 1450 ppm to 1500 ppm.

In some embodiments, the initial concentration of the at least one antimicrobial agent in the runoff is from 50 ppm to 1500 ppm, from 100 ppm to 1450 ppm, from 150 ppm to 1400 ppm, from 200 ppm to 1350 ppm, from 250 ppm to 1300 ppm, from 300 ppm to 1250 ppm, from 350 ppm to 1200 ppm, from 400 ppm to 1150 ppm, from 450 ppm to 1100 ppm, from 500 ppm to 1050 ppm, from 550 ppm to 1000 ppm, from 600 ppm to 950 ppm, from 650 ppm to 900 ppm, from 700 ppm to 850 ppm, or from 750 ppm to 850 ppm.

As used herein, the term "antimicrobial scavenger layer" means a layer of material that is configured to capture at least one antimicrobial agent while permitting other substances, including for example, water, to pass therethrough.

As used herein, the term "excess runoff" means runoff that has passed through the antimicrobial scavenger layer.

As used herein, the term "shingle mimicking layer" means a layer of material that may be sized and/or shaped so as to have the aesthetic appearance of a shingle.

As used herein, the term "water barrier layer" means a roofing material that may be configured to be positioned under the antimicrobial scavenger layer so as to direct excess runoff towards a collection system, including, without limitation, a gutter. In some embodiments, the water barrier layer comprises a polymer film, a thermoplastic film, a water-resistant coating, an asphaltic film, an asphaltic layer, glassmat, glassmat coated with at least one water resistant material, shingle fabric, an extruded plastic layer, a polyester film, foil, composites, a multi-layer film, roofing felt, or any combination thereof.

All prior patents, publications, and test methods referenced herein are incorporated by reference in their entireties.

Some embodiments of the present disclosure relate to a roofing system. In some embodiments, the roofing system includes at least one steep slope roof substrate. In some embodiments, the at least one steep slope roof substrate comprises a plywood substrate, a glass substrate, a fiberglass substrate (e.g., a fiberglass mat), a cellulosic substrate, an underlayment, a roof deck, a PV panel, a MODBIT substrate, a roll good, or any combination thereof.

In some embodiments, the at least one steep slope roof substrate comprises at least one region. In some embodiments, the at least one steep slope roof substrate comprises a plurality of regions.

In some embodiments, at least one steep slope roof substrate comprises an first region. In some embodiments, the first region of the at least one steep slope roof substrate comprises a plurality of shingles. In some embodiments, the plurality of shingles are asphalt shingles. In some embodiments, the shingles comprise asphalt, wood, metal, slate, clay, ceramic, concrete, a polymer composite, or any combination thereof. In some embodiments, the shingles comprise at least one antimicrobial agent. In some embodiments, the shingles comprise a plurality of antimicrobial pellets. In some embodiments the antimicrobial pellets comprise a polymer matrix, at least one antimicrobial agent, or any combination thereof. In some embodiments, the at least one antimicrobial agent is present within the polymer matrix. In some embodiments, the polymer matrix comprises polyethylene (PE), polypropylene (PP), or any combination thereof.

In some embodiments, the at least one steep slope roof substrate comprises a second region. In some embodiments, the second region of the at least one steep slope roof substrate comprises an antimicrobial scavenger layer. In some embodiments, the second region is downslope from the first region. In some embodiments, the antimicrobial scavenger may be positioned on the second region of the steep slope roof substrate so that it can be replaced. In some embodiments, the antimicrobial scavenger layer may be configured to receive runoff from the first region of the steep slope roof substrate. In some embodiments, the antimicrobial scavenger layer comprises at least one core region that may be configured to capture at least one antimicrobial agent while permitting other substances, including for example, water, to pass therethrough. In some embodiments, the antimicrobial scavenger layer is configured to capture the at least one antimicrobial agent so as to reduce the initial concentration of the at least one antimicrobial agent in the runoff.

In some embodiments, the at least one core region may be configured to capture the at least one antimicrobial agent via ion exchange, osmosis, filtration, activated carbons, ultrafiltration, surface absorption, chelating agents, chemical binding, or any combination thereof. In some embodiments, the core region may comprise a salt water exchange that may be configured to rejuvenate the antimicrobial agent.

In some embodiments, the core region may comprise at least one material that is configured to absorb leached copper ions, metal ions, or any combination thereof, from the at least one antimicrobial agent. In some embodiments, the at least one material in the core region includes at least one metal, copper, or any combination thereof.

In some embodiments, the core region of the antimicrobial scavenger layer may include activated carbon particles that may be configured to absorb copper ions, metal ions, or any combination thereof. In some embodiments, the activated carbon particles may be encapsulated inside a porous material. In some embodiments, the porous material may be a film, fabric, or any combination thereof.

In some embodiments, the core of the antimicrobial scavenger layer may include porous filtering media. In some embodiments, the porous filtering media contains a chelating resin, including without limitation, bis-picolylamine or iminodiacetate, a cation exchanger having sulfonic acid functionalities, or any combination thereof.

In some embodiments, the core region may include a biological region. In some embodiments, the biological region may be configured to capture the at least one antimicrobial agent. In some embodiments, the biological region comprises fungi, algae, cyanobacteria, or any combination thereof.

In some embodiments, the antimicrobial scavenger layer may include a plurality of core regions. In some embodiments, each of the core regions may be configured to capture the at least one antimicrobial agent via the same means. In some embodiments, the core regions may be configured to capture the at least one antimicrobial agent via different means.

In some embodiments, the core region may be structured so as to be configured to progressively capture the at least one antimicrobial agent. In some embodiments, core region may be structured so as to be configured to capture different sized antimicrobial agents.

In some embodiments, the second region of the at least one steep slope roof substrate includes a shingle mimicking layer. In some embodiments, the shingle mimicking layer may be disposed atop the antimicrobial scavenger layer. In some embodiments, the shingle mimicking layer includes a plurality of openings. In some embodiments, the plurality of openings are sufficiently sized so as to allow the runoff to penetrate through the shingle mimicking layer to the antimicrobial scavenger layer.

In some embodiments, the plurality of openings in the shingle mimicking layer includes a plurality of perforations. In some embodiments, the plurality of perforations may have an average size from 0.01" to 0.25". In some embodiments, the plurality of perforations may have an average size from 0.01" to 0.2", from 0.01" to 0.15" from 0.01" to 0.1", from 0.01" to 0.05", from 0.05" to 0.25", from 0.1" to 0.25", from 0.15" to 0.25", from 0.2" to 0.25", from 0.05" to 0.2", or from 0.1" to 0.15"

In some embodiments, the plurality of openings in the shingle mimicking layer includes a plurality of pores in a porous material. In some embodiments, the pores have an average size from 5 μm to 1000 μm, from 5 μm to 900 μm, from 5 μm to 800 μm, from 5 μm to 700 μm, from 5 μm to 600 μm, from 5 μm to 500 μm, from 5 μm to 400 μm, from 5 μm to 300 μm, from 5 μm to 200 μm, from 5 μm to 100 μm, from 100 μm to 1000 μm, from 200 μm to 1000 μm, from 300 μm to 1000 μm, from 400 μm to 1000 μm, from 500 μm to 1000 μm, from 600 μm to 1000 μm, from 700 μm to 1000 μm, from 800 μm to 1000 μm, from 900 μm to 1000 μm, from 100 μm to 900 μm, from 200 μm to 800 μm, from 300 μm to 700 μm, or from 400 μm to 600 μm.

In some embodiments, the second region of the at least one steep slope roof substrate includes a water barrier layer. In the water barrier layer is disposed beneath the antimicrobial scavenger layer. In some embodiments, the water barrier layer may be configured to direct excess runoff towards a collection system. In some embodiments, the collection system may be configured to collect the excess runoff from the antimicrobial scavenger layer. In some embodiments, the collection system includes a gutter. In some embodiments the antimicrobial scavenger layer is positioned over at least a portion of the collection system.

In some embodiments, the excess runoff has a reduced concentration of the at least one antimicrobial agent relative to the initial concentration of the at least one antimicrobial agent in the runoff. In some embodiments, the reduced concentration of the at least one antimicrobial agent in the excess runoff ranges from 0 ppm to 500 ppm.

In some embodiments, the reduced concentration of the at least one antimicrobial agent in the excess runoff ranges from 50 ppm to 500 ppm, from 100 ppm to 500 ppm, from 150 ppm to 500 ppm, from 200 ppm to 500 ppm, from 250 ppm to 500 ppm, from 300 ppm to 500 ppm, from 350 ppm to 500 ppm, from 400 ppm to 500 ppm, from 450 ppm to 500 ppm, from 0 ppm to 450 ppm, from 0 ppm to 400 ppm, from 0 ppm to 350 ppm, from 0 ppm to 300 ppm, from 0 ppm to 250 ppm, from 0 ppm to 200 ppm, from 0 ppm to 150 ppm, from 0 ppm to 100 ppm, from 0 ppm to 50 ppm, from 50 ppm to 450 ppm, from 100 ppm to 400 ppm, from 150 ppm to 350 ppm, or from 200 ppm to 300 ppm.

In some embodiments, the at least one steep slope roof substrate comprises a roof deck and an underlayment. In some embodiments, the underlayment is disposed atop the roof deck. In some embodiments, the underlayment is disposed beneath the plurality of shingles, disposed beneath the antimicrobial scavenger layer, or any combination thereof.

In some embodiments the first region of the at least one steep slope roof substrate does not overlap with the second region of the at least one steep slope roof substrate. In some embodiments, the first region of the at least one steep slope substrate overlaps with the second region of the at least one steep slope roof substrate. In some embodiments, at least one of the plurality of shingles on the first region of the at least one steep slope roof substrate overlaps with at least a portion of the antimicrobial scavenger layer. In some embodiments, at least one of the plurality of shingles on the first region of the at least one steep slope roof substrate overlaps with at least a portion of the shingle mimicking layer.

Some embodiments of the present disclosure relate to a method. In some embodiments, the method includes obtaining a plurality of shingles. In some embodiments, the shingles comprise at least one antimicrobial agent. In some embodiments, the method includes installing the plurality of shingles on a first region of a steep slope roof deck.

In some embodiments, the method also includes obtaining an antimicrobial scavenger material and installing the antimicrobial scavenger material on a second region of the steep slope roof deck so as to form an antimicrobial scavenger layer. In some embodiments, installing the antimicrobial scavenger material includes obtaining a water barrier material, positioning the water barrier material atop the second region of the steep slope roof deck so as to form a water barrier layer, and positioning the antimicrobial scavenger material atop the water barrier layer so as to form the antimicrobial scavenger layer atop the water barrier layer. In some embodiments, installing the antimicrobial scavenger material comprises obtaining a shingle mimicking material and positioning the shingle mimicking material atop the antimicrobial scavenger layer so as to form a shingle mimicking layer atop the antimicrobial scavenger layer.

In some embodiments, the method includes obtaining a collection system and installing the collection system relative to the antimicrobial scavenger layer so that the collection system may be configured to collect excess runoff from the antimicrobial scavenger layer.

The present disclosure will now be described with reference to non-limiting exemplary embodiments depicted in FIGS. 1-3.

FIG. 1 depicts an exemplary embodiment of a system 10 of the present disclosure. As shown in FIG. 1, in some embodiments, the system 10 includes a steep slope roof substrate 30 having a first region 12 and a second region 14. In some embodiments, as shown in FIG. 1, the second region is downslope from the first region. In addition, as shown in FIG. 1, in some embodiments, a plurality of shingles 16 are atop the first region 12 of the steep slope roof substrate 30.

FIG. 1 depicts that in some embodiments, the second region 14 of the steep slope roof substrate 30 has an antimicrobial scavenger layer 18. As shown in FIG. 1, in some embodiments, at least one of the plurality of shingles 16 on the first region 12 of the steep slope roof substrate 30 overlaps with the antimicrobial scavenger layer 18. In the exemplary embodiment of FIG. 1, the system 10 includes a collection system 24, which may be a gutter.

As depicted in FIG. 1, in some embodiments, the steep slope roof substrate 30 may be a roof deck. In addition, as shown in FIG. 1, in some embodiments, an underlayment 28 may be atop the steep slope roof substrate 30 and below the plurality of the shingles 16. As shown in FIG. 1, in some embodiments, a water barrier layer 26 is positioned below the antimicrobial scavenger layer 18. As shown in FIG. 1, in some embodiments, the underlayment 28 overlaps over the entire water barrier layer 26. In other embodiments, the underlayment 28 overlaps at least a portion of the water barrier layer 26. In some embodiments, the underlayment 28 overlaps at least 2" of the water barrier layer 26. In some embodiments, the underlayment 28 overlaps at least 3" of the water barrier layer 28. In some embodiments, the underlayment 28 overlaps at least 4" of the water barrier layer 28.

In some embodiments, the underlayment 28 overlaps at least 5" of the water barrier layer 26.

In some embodiments, the plurality of shingles 16 depicted in FIG. 1 may include at least one antimicrobial agent. In an exemplary embodiment of the present disclosure, the plurality of shingles 16 may be asphalt shingles and the antimicrobial agent on the plurality of shingles 16 may comprise biocide, algaecide, or any combination thereof.

In some embodiments, when water 20, such as rainwater, falls onto the plurality of shingles 16, the at least one antimicrobial agent may leach out into the water 20 so as to form runoff 22 having water 20 and an initial concentration of the at least one antimicrobial agent.

As depicted in FIG. 1, in some embodiments the runoff 22 is received by the antimicrobial scavenger layer 18. As shown in FIG. 1, in some embodiments, the water barrier layer 26 extends under at least a portion of the scavenger layer 18. In some embodiments, the water barrier layer 26 extends at least 2" under the scavenger layer 18. In some embodiments, the water barrier layer 26 extends at least 3" under the scavenger layer 18. In some embodiments, the water barrier layer 26 extends at least 4" under the water barrier layer 26 extends at least 5" under the scavenger layer 18.

In some embodiments, the antimicrobial scavenger layer 18 is configured to capture the at least one antimicrobial agent so as to reduce the initial concentration of the at least one antimicrobial agent in the runoff 22.

As shown in FIG. 1, in some embodiments, excess runoff, which is runoff 22 that has a reduced concentration of the at least one antimicrobial agent after having passed through the antimicrobial scavenger layer 18, is received in the collection system 24. As shown in FIG. 1, in some embodiments, the water barrier layer 26 may direct the excess runoff away from the underlayment 28 on the first region 12 of the steep slope roof substrate 30 and into the collection system 24.

Figure 2:
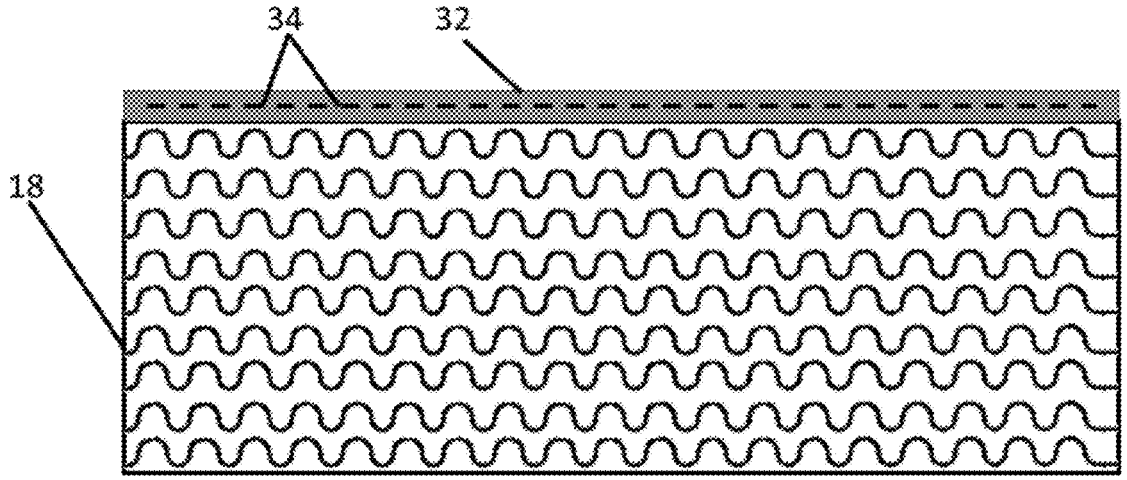
FIG. 2 depicts a scavenger layer of a roofing system according to an exemplary embodiment of the present disclosure.

FIG. 2 depicts an antimicrobial scavenger layer 18 according to an exemplary embodiment of the present disclosure. As shown in FIG. 2, in some embodiments, a shingle mimicking layer 32 may be positioned atop the antimicrobial scavenger layer 18. In the exemplary embodiment of FIG. 2, the shingle mimicking layer 32 includes a plurality of perforations 34. In some embodiments, the plurality of perforations 34 may be configured to receive the runoff 22 so that the runoff 22 may pass through the shingle mimicking layer 32 to the antimicrobial scavenger layer 18.

Figure 3:
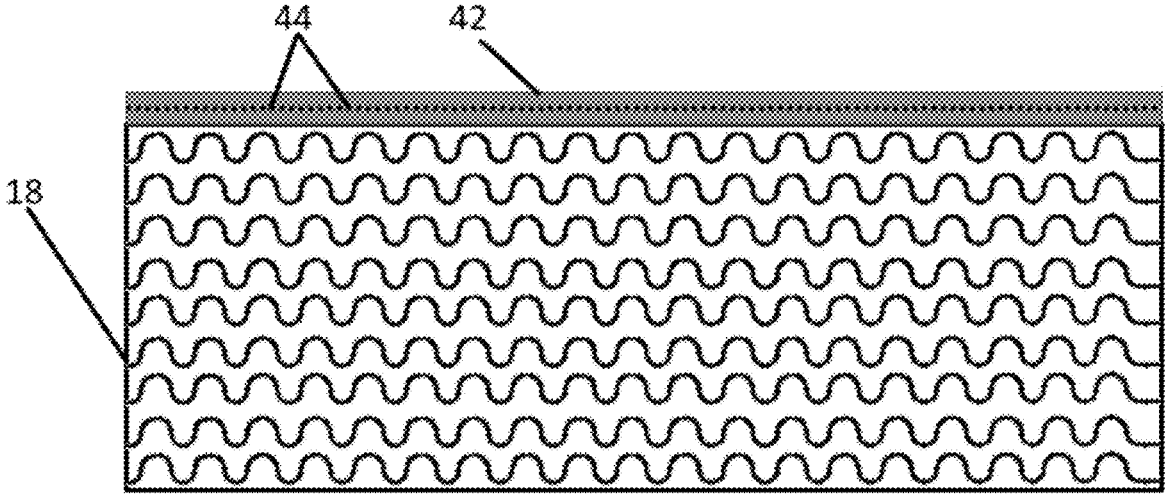
FIG. 3 depicts a scavenger layer of a roofing system according to an exemplary embodiment of the present disclosure.

FIG. 3 depicts an antimicrobial scavenger layer 18 according to an exemplary embodiment of the present disclosure. As shown in FIG. 3, in some embodiments, a shingle mimicking layer 42 may be positioned atop the antimicrobial scavenger layer 18. In the exemplary embodiment of FIG. 3, the shingle mimicking layer 42 may be a porous material having a plurality of pores 44. In some embodiments, the plurality of pores 44 may be configured to receive the runoff 22 so that the runoff 22 may pass through the shingle mimicking layer 42 to the antimicrobial scavenger layer 18.

Variations, modifications and alterations to embodiments of the present disclosure described above will make themselves apparent to those skilled in the art. All such variations, modifications, alterations and the like are intended to fall within the spirit and scope of the present disclosure.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present disclosure.

The disclosure described herein may be practiced in the absence of any element or elements, limitation or limitations, which is not specifically disclosed herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A roofing system comprising:

a steep slope roof substrate comprising a first region and a second region downslope of the first region;

a plurality of shingles located on the first region of the steep slope roof substrate, wherein at least some of the plurality of shingles comprise an antimicrobial agent;

an antimicrobial scavenger material located on the second region of the steep slope roof substrate, so as to form an antimicrobial scavenger layer, wherein the antimicrobial scavenger layer is configured to receive runoff from the plurality of shingles on the first region of the steep slope roof substrate, wherein the runoff comprises:

at least one antimicrobial agent; and water;

wherein the antimicrobial scavenger layer is configured to capture the at least one antimicrobial agent so as to reduce a concentration of the at least one antimicrobial agent in the runoff; and a water barrier material located atop the second region of the steep slope roof substrate so as to form a water barrier layer;

wherein the antimicrobial scavenger layer is located atop the water barrier layer.

2. The roofing system of claim 1, wherein the plurality of shingles comprises:

a polymer matrix; and the at least one antimicrobial agent.

3. The roofing system of claim 2, wherein the at least one antimicrobial agent is present within the polymer matrix.

4. The roofing system of claim 2, wherein the polymer matrix comprises polyethylene (PE), polypropylene (PP), or any combination thereof.

5. The roofing system of any of claim 1, wherein the at least one antimicrobial agent comprises at least one metal, at least one metal ion, or any combination thereof.

6. The roofing system of claim 5, wherein the at least one metal, the at least one metal ion, or the combination thereof comprises copper, at least one copper ion, or any combination thereof.

7. The roofing system of claim 1, wherein the at least one antimicrobial agent comprises at least one algaecide, at least one biocide, at least one fungicide, or any combination thereof.

8. The roofing system of claim 1, wherein the roofing system further comprises a collection system, wherein the collection system is configured to collect the runoff from the antimicrobial scavenger layer.

9. The roofing system of claim 8, wherein the collection system comprises a gutter.

10. The roofing system of claim 8, wherein the runoff in the collection system has a reduced concentration of the at least one antimicrobial agent relative to an initial concentration of the at least one antimicrobial agent in the runoff from the first region of the steep slope roof substrate.

11. The roofing system of claim 10, wherein the reduced concentration of the at least one antimicrobial agent in the runoff in the collection system is 0 ppm to 500 ppm.

12. The roofing system of claim 1, wherein the concentration of the at least one antimicrobial agent in the runoff from the first region of the steep slope roof substrate is 50 ppm to 1500 ppm.

13. The roofing system of claim 1, further comprising:

a shingle mimicking layer, wherein the shingle mimicking layer is disposed atop the antimicrobial scavenger layer, wherein the shingle mimicking layer comprises a plurality of openings, wherein the plurality of openings are sufficiently sized so as to allow the runoff to penetrate through the antimicrobial scavenger layer.

14. The roofing system of claim 13, wherein the shingle mimicking layer comprises a porous material, wherein the plurality of openings comprise a plurality of pores of the porous material, wherein the pores have an average size of 5 μm to 1000 μm.

15. The roofing system of claim 1, further comprising:

an underlayment, wherein the underlayment is disposed beneath the plurality of shingles.

16. The roofing system of claim 1, wherein the at least one of the plurality of shingles overlaps at least one portion of the antimicrobial scavenger layer.

17. A method comprising:

obtaining a plurality of shingles, wherein at least some of the plurality of shingles comprises an antimicrobial agent;

installing the plurality of shingles on a first region of a steep slope roof substrate;

obtaining an antimicrobial scavenger material;

installing the antimicrobial scavenger material on a second region of the steep slope roof substrate so as to form an antimicrobial scavenger layer, wherein the second region is downslope of the first region;

wherein the antimicrobial scavenger layer is configured to receive runoff from the plurality of shingles on the first region of the steep slope roof substrate, wherein the runoff comprises:

at least one antimicrobial agent; and water; and wherein installing the antimicrobial scavenger material on the second region of the steep slope roof substrate comprises:

obtaining a water barrier material;

positioning the water barrier material atop the second region of the steep slope roof substrate so as to form a water barrier layer; and positioning the antimicrobial scavenger material atop the water barrier layer so as to form the antimicrobial scavenger layer atop the water barrier layer;

wherein the antimicrobial scavenger layer is configured to capture the at least one antimicrobial agent so as to reduce a concentration of the at least one antimicrobial agent in the runoff.

18. The method of claim 17, wherein the method further comprises:

obtaining a collection system wherein the collection system is configured to collect the runoff from the antimicrobial scavenger layer; and installing the collection system.

* * * * *